US012491978B2

(12) United States Patent
Koga et al.

(10) Patent No.: US 12,491,978 B2
(45) Date of Patent: Dec. 9, 2025

(54) MARINE PROPULSION DEVICE WITH SIMPLIFIED WIRING OF POWER LINES

(71) Applicant: YAMAHA HATSUDOKI KABUSHIKI KAISHA, Iwata (JP)

(72) Inventors: Hiroki Koga, Shizuoka (JP); Yoshiyuki Kadobayashi, Shizuoka (JP); Akihiro Noma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 584 days.

(21) Appl. No.: 18/095,010

(22) Filed: Jan. 10, 2023

(65) Prior Publication Data

US 2023/0264799 A1 Aug. 24, 2023

(30) Foreign Application Priority Data

Feb. 24, 2022 (JP) ..... 2022-026787

(51) Int. Cl.

| | |
|---|---|
| ***B63H 23/24*** | (2006.01) |
| ***B63H 20/00*** | (2006.01) |
| ***B63H 20/14*** | (2006.01) |
| ***B63H 20/20*** | (2006.01) |
| ***B63H 21/14*** | (2006.01) |

(Continued)

(52) U.S. Cl.

CPC ..... *B63H 23/24* (2013.01); *B63H 20/00* (2013.01); *B63H 20/14* (2013.01); *B63H 20/20* (2013.01); *B63H 21/14* (2013.01); *B63H 21/17* (2013.01); *B63H 21/21* (2013.01); *B63H 21/36* (2013.01); *B63H 23/04* (2013.01); *B63H 23/30* (2013.01); *B63H 2021/216* (2013.01)

(58) Field of Classification Search

CPC ..... B63H 20/00; B63H 20/14; B63H 20/32; B63H 21/14; B63H 21/17; B63H 21/20; B63H 2021/202; B63H 2021/205; B63H 21/21; B63H 2021/216; B63H 21/36; B63H 23/04; B63H 23/08; B63H 23/24; B63H 2023/245; B63H 23/30

See application file for complete search history.

(56) References Cited

U.S. PATENT DOCUMENTS 3,230,698 A * 1/1966 Nettles ..... B63H 20/14 60/718
3,703,642 A * 11/1972 Balaguer ..... B63H 20/007 290/46

(Continued)

FOREIGN PATENT DOCUMENTS

JP 2010-158926 A 7/2010
JP 2018099903 A * 6/2018 ..... B63H 25/42

(Continued)

*Primary Examiner* — Ajay Vasudeva
(74) *Attorney, Agent, or Firm* — Keating & Bennett, LLP

(57) ABSTRACT

A marine propulsion device includes a drive shaft, a propeller shaft, and a lower case that houses the propeller shaft. In the marine propulsion device, a power generator generates power using a torque of the drive shaft or the propeller shaft, and the generated power is supplied to an electric actuator to drive a driven unit through a first power line, wherein the electric actuator is controlled by a controller. At least a portion of the driven unit, at least a portion of the electric actuator, at least a portion of the power generator, and the first power line are located in the lower case.

12 Claims, 8 Drawing Sheets

(51) Int. Cl.

| | |
|---|---|
| ***B63H 21/17*** | (2006.01) |
| ***B63H 21/21*** | (2006.01) |
| ***B63H 21/36*** | (2006.01) |
| ***B63H 23/04*** | (2006.01) |
| ***B63H 23/30*** | (2006.01) |

(56) References Cited

U.S. PATENT DOCUMENTS

| | | | | |
|---|---|---|---|---|
| 7,637,790 | B1 * | 12/2009 | Guerra | B63H 20/14 440/6 |
| 8,246,399 | B2 * | 8/2012 | Inaba | B63H 20/12 440/58 |
| 8,454,402 | B1 * | 6/2013 | Arbuckle | B63H 21/21 440/86 |
| 10,059,417 | B1 * | 8/2018 | Hilbert | B63H 21/213 |
| 10,150,550 | B2 * | 12/2018 | Nakamura | B63H 23/30 |
| 2010/0173543 | A1 | 7/2010 | Inaba | |
| 2020/0062362 | A1 | 2/2020 | Nakamura et al. | |
| 2024/0132192 | A1 * | 4/2024 | Conti | B63H 25/42 |

FOREIGN PATENT DOCUMENTS

| | | | | |
|---|---|---|---|---|
| JP | 2020-29186 | A | 2/2020 | |
| WO | WO-2024095027 | A1 * | 5/2024 | B63H 23/30 |

* cited by examiner

MARINE PROPULSION DEVICE WITH SIMPLIFIED WIRING OF POWER LINES

CROSS REFERENCE TO RELATED APPLICATIONS

This application claims the benefit of priority to Japanese Patent Application No. 2022-026787 filed on Feb. 24, 2022. The entire contents of this application are hereby incorporated herein by reference.

BACKGROUND OF THE INVENTION

1. Field of the Invention

The present invention relates to a marine propulsion device, in particular, to a marine propulsion device with simplified wiring of power lines.

2. Description of the Related Art

As a conventional technique, a marine propulsion device in which a power generating unit generating power using the power of a drive source and a driven unit driven by an electric actuator are disposed in a lower case is known. For example, according to Japanese Laid-open Patent Publication (Kokai) No. 2020-29186, an electric motor generates power by using the power of an engine transmitted to a propeller shaft. A battery disposed in a hull is charged with the power generated by the electric motor. A shift device as an electric actuator is run by a shift motor and switches the state of a forward-reverse shifting mechanism.

According to the prior art, since the battery is disposed in the hull, a power line that connects the electric motor and the battery together is needed. A power line for supplying the power for the shift motor from the hull when the shift actuator is operating in response to an operation on a remote control is also needed. It is thus necessary to wire these power lines from the hull to a lower case through the interior of an upper case. This makes routing of the power lines complicated and leads to upsizing of the marine propulsion device.

SUMMARY OF THE INVENTION

Preferred Embodiments of the Present Invention simplify the wiring of power lines in marine propulsion devices.

According to a preferred embodiment of the present invention, a marine propulsion device includes a drive shaft, a propeller shaft, a lower case that houses the propeller shaft, a power generator to generate power using a torque of the drive shaft or the propeller shaft, a driven unit, an electric actuator to drive the driven unit, a first power line to supply the power generated by the power generator to the electric actuator, and a controller configured or programmed to control the electric actuator, wherein at least a portion of the driven unit, at least a portion of the electric actuator, at least a portion of the power generator, and the first power line are located in the lower case.

According to this configuration, the electric actuator, which drives the driven unit, and the power generator, are wired by the first power line in the lower case. It is thus unnecessary to wire the power line from the hull to the lower case through the interior of the upper case. As a result, the wiring of the power line is simplified.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
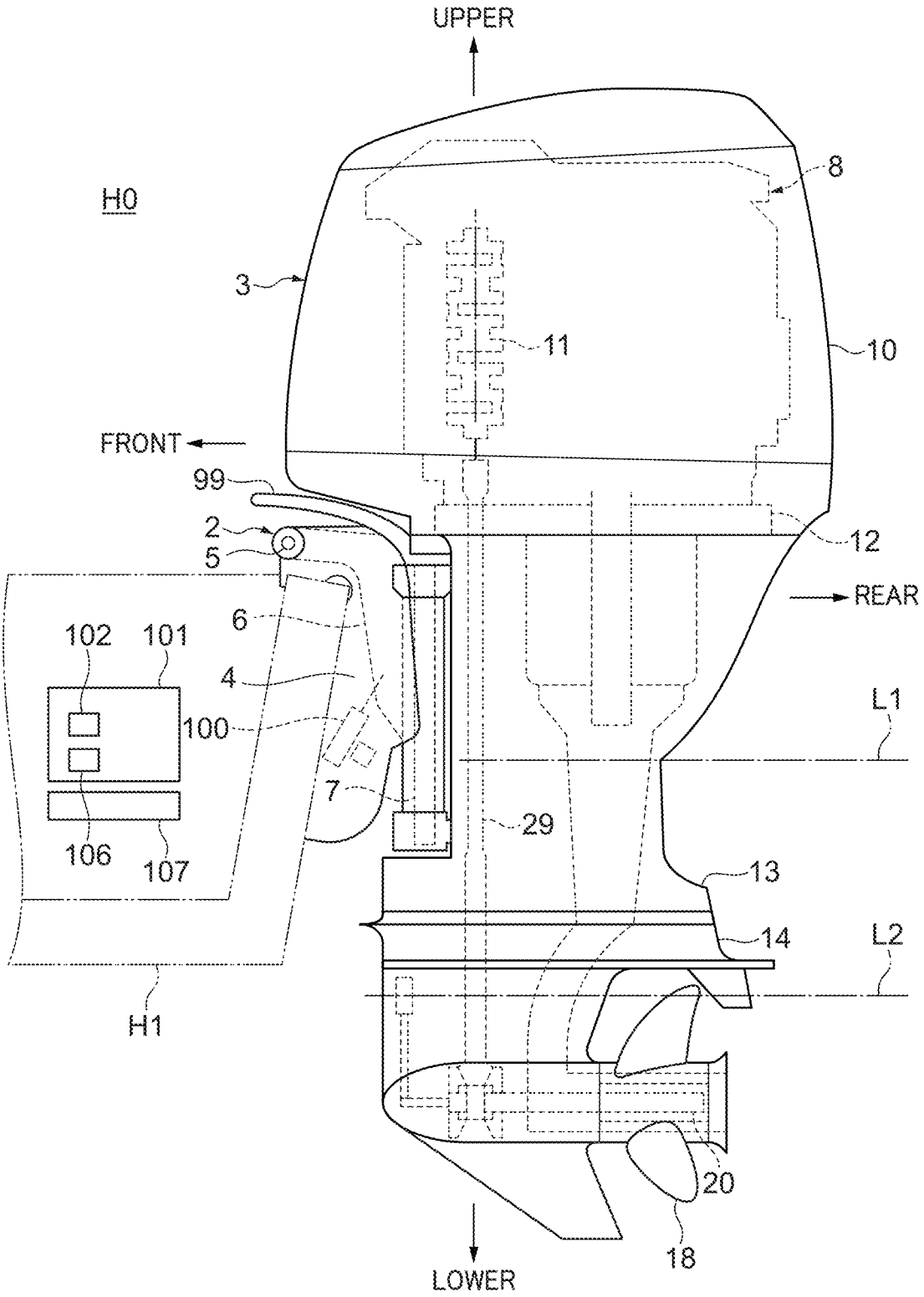
FIG. 1 is a schematic left side view of a marine propulsion device according to a first preferred embodiment of the present invention.
Figure 2:
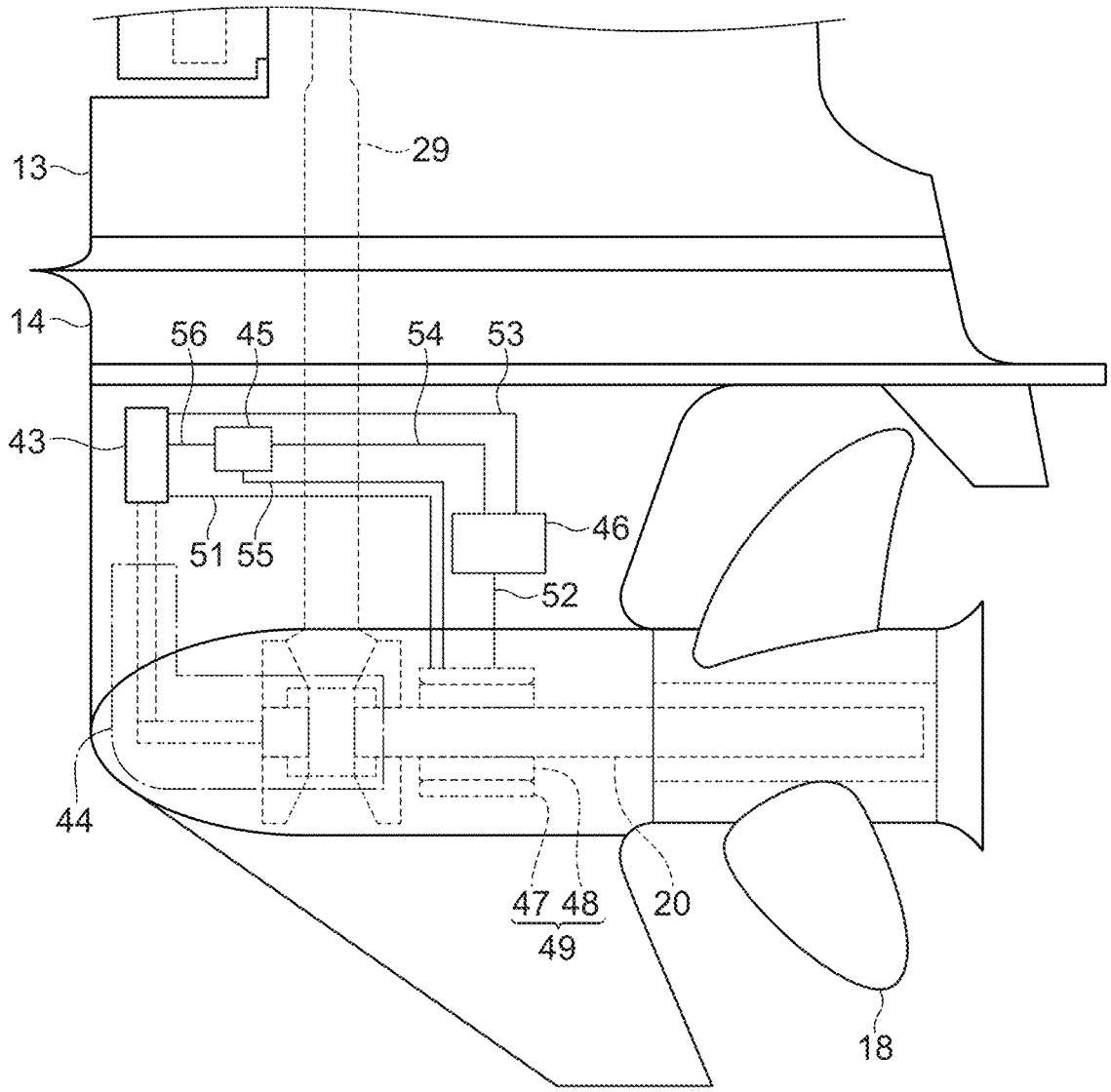
FIG. 2 is a schematic left side view of a lower portion of an outboard motor according to the first preferred embodiment of the present invention.

FIG. 1 is a schematic left side view of a marine propulsion device according to a first preferred embodiment of the present invention. FIG. 2 is a schematic left side view of a lower portion of an outboard motor 3 as an example of the marine propulsion device.

A description will now be provided of the outboard motor 3 in a reference posture. The reference posture is a posture in which the rotational axis of an engine 8 (the rotational axis of a crankshaft 11) extends in a vertical direction, and the rotational axis of a propeller shaft 20 perpendicular to the rotational axis of an engine 8 extends in a front-back direction.

As shown in FIG. 1, a marine vessel H0 includes a hull H1, and the outboard motor 3 that propels the hull H1. The outboard motor 3 is attached to the rear of the hull H1 by a suspension device 2. The outboard motor 3 also includes a steering device 99 that causes the outboard motor 3 to pivot right and left with respect to the hull H1, and a tilt device 100 that causes the outboard motor 3 to pivot up and down with respect to the hull H1.

The suspension device 2 includes a clamp bracket 4 that is attachable to the stern, a swivel bracket 6 held by the clamp bracket 4, and a steering shaft 7 held by the swivel bracket 6. The swivel bracket 6 is rotatable around a tilting shaft 5, which extends in a horizontal direction, with respect to the clamp bracket 4. The steering shaft 7, which extends in a vertical direction, is rotatable around its axis with respect to the swivel bracket 6.

The outboard motor 3 is located at the rear of the hull H1. The outboard motor 3 is rotatable around the axis of the steering shaft 7 together with the steering shaft 7, and rotatable around the axis of the tilting shaft 5 with respect to the hull H1.

The outboard motor 3 includes a casing including a cowl 10 that houses an engine 8, an exhaust guide 12 below the engine 8, an upper case 13 below the exhaust guide 12, and a lower case 14 below the upper case 13. The engine 8 generates power to rotate a propeller 18. The rotational power of the engine 8 is transmitted to the propeller 18 via the propeller shaft 20.

A drive shaft 29 extends in the vertical direction below the engine 8. As shown in FIG. 2, a forward-reverse shifting mechanism 44 (a shifting unit) as a driven unit is connected to a lower end of the drive shaft 29. The drive shaft 29 extends through the upper case 13 and the lower case 14. The forward-reverse shifting mechanism 44 and the propeller shaft 20 are located in the lower case 14. The propeller shaft 20 is housed in the lower case 14 and extends in the front-back direction. The propeller 18 is attached to a rear end of the propeller shaft 20 and located in a rear portion of the lower case 14. The propeller 18 rotates in a forward direction or a reverse direction together with the propeller shaft 20. Detailed description of the forward-reverse shifting mechanism 44 will be provided below with reference to FIG. 3 to FIG. 5.

The engine 8 rotates the drive shaft 29 in a constant rotational direction. The forward-reverse shifting mechanism 44 is able to switch to a forward state in which rotation in the forward direction is transmitted from the drive shaft 29 to the propeller shaft 20, and to a reverse state in which rotation in the reverse direction is transmitted from the drive shaft 29 to the propeller shaft 20. The forward-reverse shifting mechanism 44 is also able to switch to a neutral state in which the rotation from the drive shaft 29 to the propeller shaft 20 is interrupted. By switching the state of the forward-reverse shifting mechanism 44, a shift actuator 43 of the outboard motor 3 switches the direction of rotation transmitted from the engine 8 to the propeller 18. The outboard motor 3 includes an outboard motor ECU (Electronic Control Unit) 45.

A remote control unit 101 and a remote control ECU 107 are located in the hull H1 (FIG. 1). The remote control unit 101 includes an operating lever 102 and a lever position sensor 106. A user is able to operate the operating lever 102 by tilting it. The operating lever 102 is an operating member that is operable to adjust the output of the marine propulsion device, and also to shift the marine vessel H0 between forward and reverse. The remote control unit 101 may be provided with a throttle operating member and a shift operating member, which are independent of each other, in place of the operating lever 102.

The operating lever 102 is able to be tilted back and forth from a neutral position, wherein the neutral position is a point of origin at which the outboard motor 3 generates no propulsive force. The lever position sensor 106 detects an operating position of the operating lever 102. In accordance with a result of the detection by the lever position sensor 106, the remote control ECU 107 outputs, to the outboard motor ECU 45 (FIG. 2), a shifting signal to switch the shift position of the forward-reverse shifting mechanism 44 or an output change signal to change the output of the engine 8. The outboard motor ECU 45 controls, based on a signal input from the remote control ECU 107, switching of the shift position of the forward-reverse shifting mechanism 44 and changing of the output of the engine 8.

The outboard motor 3 further includes, although not illustrated in the drawings, a throttle actuator, a fuel supply device, a speed sensor to detect the rotational speed of the engine 8, a starter motor, and so forth. A signal line from the remote control unit 101 to the outboard motor ECU 45 and a power line from a power source in the hull H1 to the outboard motor ECU 45 are routed through the interior of the upper case 13.

Next, referring to FIG. 2, a description will be provided of configurations and arrangement of component elements.

A power generating unit 49 is located in the lower case 14. The power generating unit 49 includes a power generating motor to generate power using the torque of the propeller shaft 20. The power generating unit 49 includes a coil 47 and a magnet 48, both of which are located around the propeller shaft 20. The magnet 48 is fixed to the propeller shaft 20 and rotates in conjunction with the propeller shaft 20. The coil 47 is fixed to the lower case 14, and the magnet 48 is rotatable relatively to the coil 47.

A capacitor 46 is located in the lower case 14. The capacitor 46 stores power (electricity) generated by the power generating unit 46. A shift actuator 43 is located in the lower case 14. The shift actuator 43 includes an electric actuator to drive the forward-reverse shifting mechanism 44. The outboard motor ECU 45 includes a controller to control the shift actuator 43. The outboard motor ECU 45 is located in the lower case 14.

A first power line 51 is wired from the power generating unit 49 to the shift actuator 43. The first power line supplies the power generated by the power generating unit 49 to the shift actuator 43. A second power line 52 is wired from the power generating unit 49 to the capacitor 46. The second power line 52 supplies the power generated by the power generating unit 49 to the capacitor 46. A third power line 53 is wired from the capacitor 46 to the shift actuator 43. The third power line 53 supplies the power from the capacitor 46 to the shift actuator 43.

A fourth power line 54 is wired from the capacitor 46 to the outboard motor ECU 45. The fourth power line 54 supplies the power from the capacitor 46 to the outboard motor ECU 45. A fifth power line 55 is wired from the power generating unit 49 to the outboard motor ECU 45. The fifth power line 55 supplies the power generated by the power generating unit 49 to the outboard motor ECU 45.

The outboard motor ECU 45 and the shift actuator 43 are connected to each other by a signal line 56. A control signal from the outboard motor ECU 45 is supplied to the shift actuator 43 through the signal line 56.

In a state where the engine 8 is not running such as an initial sate, the power is supplied from the capacitor 46 to the outboard motor ECU 45. When the power generated by the power generating unit 49 is insufficient, the power is supplied from the capacitor 46 to the outboard motor ECU 45 and the shift actuator 43.

As described above, all of the outboard motor ECU 45, the capacitor 46, the power generating unit 49, and the shift actuator 43 are located in the lower case 14. All of the power lines 51 to 55 and the signal line 56 are wired in the lower case 14 and are not located in the upper case 13. The wiring of the power lines 51 to 55 and the signal line 56 is completed in the lower case 14, that is, the wiring is simplified.

Figure 3:
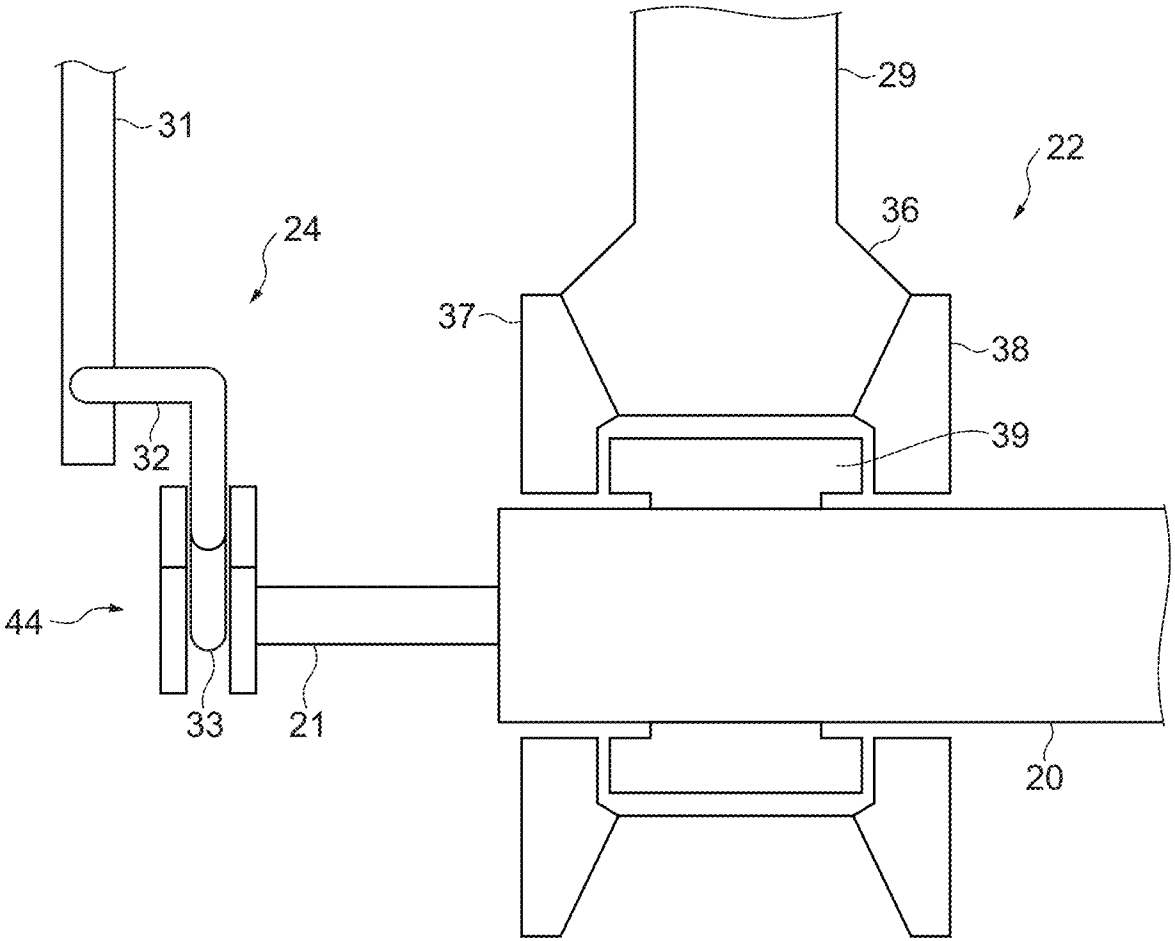
FIG. 3 is a partial enlarged schematic view useful in explaining configurations of a forward-reverse shifting mechanism and a clutch mechanism.
Figure 4:
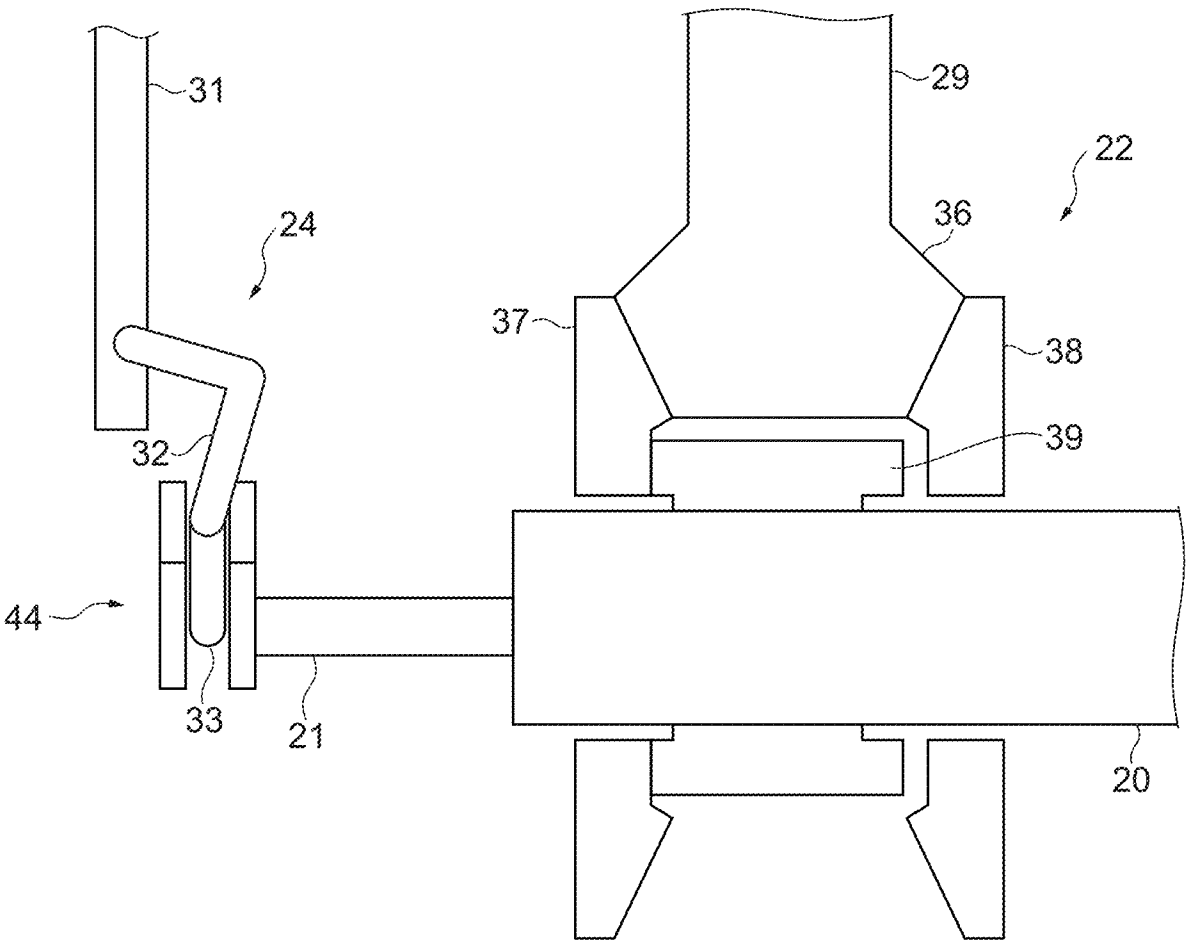
FIG. 4 is a partial enlarged schematic view useful in explaining the configurations of the forward-reverse shifting mechanism and the clutch mechanism.
Figure 5:
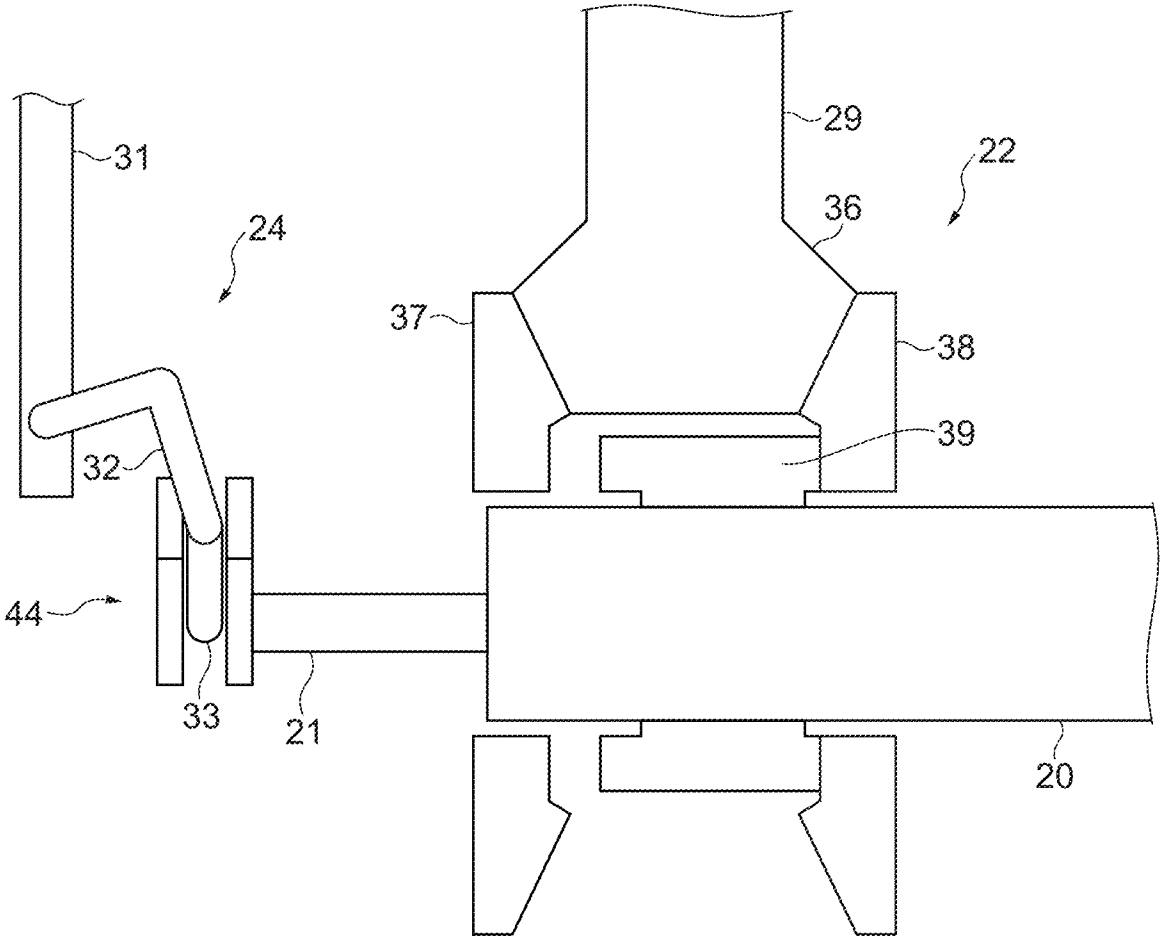
FIG. 5 is a partial enlarged schematic view useful in explaining the configurations of the forward-reverse shifting mechanism and the clutch mechanism.

FIG. 3 to FIG. 5 are partial enlarged schematic views useful in explaining configurations of the forward-reverse shifting mechanism 44 and the clutch mechanism 22.

The forward-reverse shifting mechanism 44 includes the shift link mechanism 24 and the clutch mechanism 22. The shift link mechanism 24 includes a shift slider 21, a shift rod 31, a link arm 32, and a pusher 33. The clutch mechanism 22 includes a driver gear 36, a forward driven gear 37, a reverse driven gear 38, and a dog clutch 39. The engine 8 and the clutch mechanism 22 are connected to each other by the drive shaft 29.

The shift actuator 43 moves the shift rod 31 up and down using hydraulic pressure generated by operation of a shift motor (not illustrated). Note that the shift actuator 43 may be configured to mechanically convert the rotation of the shift motor to the upward and downward movement of the shift rod 31 through a ball screw.

In the shift link mechanism 24, the shift rod 31 is connected to one end of the link arm 32, which is L-shaped, while an end of the shift slider 21 is connected to the other end of the link arm 32 via the pusher 33. The link arm 32 moves the shift slider 21 in the axial direction by converting the upward and downward movement of the shift rod 31 to the forward and backward movement of the pusher 33.

The clutch mechanism 22 includes a cylindrical dog clutch 39, as well as the drive gear 36, the forward driven gear 37, and the reverse driven gear 38, all of which are preferably bevel gears. The drive gear 36 is fixed to a lower end of the drive shaft 29 and rotates with the drive shaft 29. The forward driven gear 37 includes the propeller shaft 20 in a circumferential direction. The surface of a board of the reverse driven gear 38 faces the surface of a board of the forward driven gear 37. The dog clutch 39 is between the forward driven gear 37 and the reverse driven gear 38 in the axial direction of the propeller shaft 20 (hereafter referred to merely as the axial direction).

The dog clutch 39 is a sleeve-shaped member including the propeller shaft 20 in a circumferential direction. A plurality of grooves extending in the axial direction is provided on an inner peripheral surface of the dog clutch 39, and the grooves are respectively engaged with a plurality of projections projecting from an outer periphery of the propeller shaft 20 and extending in the axial direction. As a result, the dog clutch 39 rotates with the propeller shaft 20 and also moves relatively to the propeller shaft 20 in the axial direction. A plurality of teeth are provided on a surface of the forward driven gear 37 which faces the dog clutch 39, and a plurality of teeth are also provided at an end (front end) of the dog clutch 39 which faces the forward driven gear 37. A plurality of teeth are provided on a surface of the reverse driven gear 38 which faces the dog clutch 39, and a plurality of teeth are also provided at an end (rear end) of the dog clutch 39 which faces the reverse driven gear 38. Note that the dog clutch 39 is moved in the axial direction together with the shift slider 21 by the shift link mechanism 24 via a mechanism, not shown.

In the clutch mechanism 22, both the forward driven gear 37 and the reverse driven gear 38 are always engaged with the drive gear 36 and are driven and rotated around the axis of the propeller shaft 20 by the drive gear 36. In this structure, the forward driven gear 37 and the reverse driven gear 38 face each other across the drive gear 36, and thus the forward driven gear 37 and the reverse driven gear 38 are rotated in the opposite directions.

FIG. 3 shows a case where the forward-reverse shifting mechanism 44 is in the neutral state where no driving force from the engine 8 is transmitted to the propeller 18. In the neutral state, the shift rod 31 of the shift link mechanism 24 lies at an intermediate position in a range where the shift rod 31 is movable up and down. The shift slider 21 and the dog clutch 39 lie at an intermediate position in a range where the shift slider 21 and the dog clutch 39 are movable in the axial direction, such that the dog clutch 39 engages with neither the forward driven gear 37 nor the reverse driven gear 38.

FIG. 4 shows a case where the forward-reverse shifting mechanism 44 is in the forward state, in which a driving force from the engine 8 is transmitted to the propeller 18. In the forward state, the shift rod 31 of the shift link mechanism 24 moves upward, and the shift slider 21 and the dog clutch 39 move forward in the axial direction (leftward as viewed in the drawing). The teeth at the front end of the dog clutch 39 then engage with the teeth on the surface of the forward driven gear 37 which faces the dog clutch 39.

At this time, the driving force from the engine 8 is transmitted via the drive shaft 29, the drive gear 36, the forward driven gear 37, and the dog clutch 39 to the propeller shaft 20, and rotates the propeller 18 in the forward direction. In the forward state, the propeller 18 rotates forward, and the marine vessel H0 is able to move forward.

FIG. 5 shows a case where the forward-reverse shifting mechanism 44 is in the reverse state, in which a driving force from the engine 8 is transmitted to the propeller 18. In the reverse state, the shift rod 31 of the shift link mechanism 24 moves downward, and the shift slider 21 and the dog clutch 39 move backward in the axial direction (rightward as viewed in the drawing). The teeth at the rear end of the dog clutch 39 then engage with the teeth on the surface of the reverse driven gear 38 which faces the dog clutch 39.

At this time, the driving force from the engine 8 is transmitted via the drive shaft 29, the drive gear 36, the reverse driven gear 38, and the dog clutch 39 to the propeller shaft 20, and rotates the propeller 18 in the reverse direction. In the reverse position, the propeller 18 rotates in the reverse direction, and the marine vessel H0 is able to move backward.

According to the present preferred embodiment, the shift actuator 43 is operated by the power generated by the power generating unit 49 using the torque of the propeller shaft 20 to drive the forward-reverse shifting mechanism 44. The forward-reverse shifting mechanism 44, the shift actuator 43, the power generating unit 49, and the first power line 51 are located in the lower case 14.

When assuming that the power to operate the shift actuator 43 is supplied from a battery provided in the hull H1, it would be necessary to wire a power line from the hull H1 to the lower case 14 through the interior of the upper case 13. Accordingly, the route of the power line would be long and complicated, leading to upsizing of the outboard motor 3. On the other hand, according to the present preferred embodiment, the wiring of the power line 51 from the power generating unit 49 to the shift actuator 43 is completed in the lower case 14. Therefore, the layout including the wiring of the power line is simplified, and upsizing of the outboard motor 3 is avoided.

According to the present preferred embodiment, the outboard motor 3 includes the capacitor 46 that stores the power generated by the power generating unit 49. The power generated by the power generating unit 49 is supplied to the capacitor 46 through the second power line 52, and the power is supplied from the capacitor 46 to the shift actuator 43 through the third power line 53. Thus, the forward-reverse shifting mechanism 44 is able to be driven even when the power generated by the power generating unit 49 is insufficient.

Moreover, the fourth power line 54 that supplies the power from the capacitor 46 to the outboard motor ECU 45 is provided, which makes it possible for the outboard motor ECU 45 to be operated by the power from the capacitor 46 even in the initial state where the engine 8 is not running, or even when the power generated by the power generating unit 49 is insufficient.

Further, the capacitor 46, the outboard motor ECU 45, the second power line 52, the third power line 53, and the fourth power line 54 are also located in the lower case 14, which simplifies the wiring of the second power lines 52, 53, and 54.

In addition, according to the present preferred embodiment, the signal line 56 connecting the outboard motor ECU 45 and the shift actuator 43 together is also located in the lower case 14. The fifth power line 55 to supply the power from the power generating unit 49 to the outboard motor ECU 45 is also located in the lower case 14. As a result, the wiring of the signal line 56 and the fifth power line 55 is simplified.

Note that in order to located the first power line 51 in the lower case 14, at least a portion of each of the forward-reverse shifting mechanism 44, the shift actuator 43, and the power generating unit 49 may be located in the lower case 14.

Note that as for the application of the power generating unit 49, when the propeller shaft 20 is rotated by a tidal current/water current while the marine vessel H0 is at anchor, the power generating unit 49 may generate power using this rotation, and the generated power may be stored in the capacitor 46.

Note that in order to simplify the wiring, the component elements should be arranged such that the wiring is as short as possible. From this standpoint, the forward-reverse shifting mechanism 44, the outboard motor ECU 45, the capacitor 46, the power generating unit 49, the shift actuator 43, the power lines 51 to 55, and the signal line 56 are not necessarily located in the lower case 14.

Further, there is a conceivable alternative as described below. As shown in FIG. 1, a borderline between an area that may be submerged in water while the marine vessel H0 is sailing and an area that is never submerged in water while the marine vessel H0 is sailing is designated by L2. A waterline in a state where the outboard motor 3 is in a tilt-down state and the marine vessel H0 is not sailing is designated by L1. In the outboard motor 3, at least a portion of the forward-reverse shifting mechanism 44, at least a portion of the shift actuator 43, at least a portion of the power generating unit 49, and the first power line 51 may be located at a lower level than the waterline L1. More preferably, at least a portion of the forward-reverse shifting mechanism 44, at least a portion of the shift actuator 43, at least a portion of the power generating unit 49, and the first power line 51 may be located at a lower level than the borderline L2, that is, within the area in the outboard motor 3 which is submerged in water while the marine vessel H0 is sailing.

Note that the electric actuator is not limited to the shift actuator 43. The driven unit is not limited to the forward-reverse shifting mechanism 44. The locations where the electric actuator, the driven unit, and the power generating unit 49 are placed are not limited to the illustrated ones. Descriptions will now be given of second, third, and fourth preferred embodiments as such variations.

Figure 6:
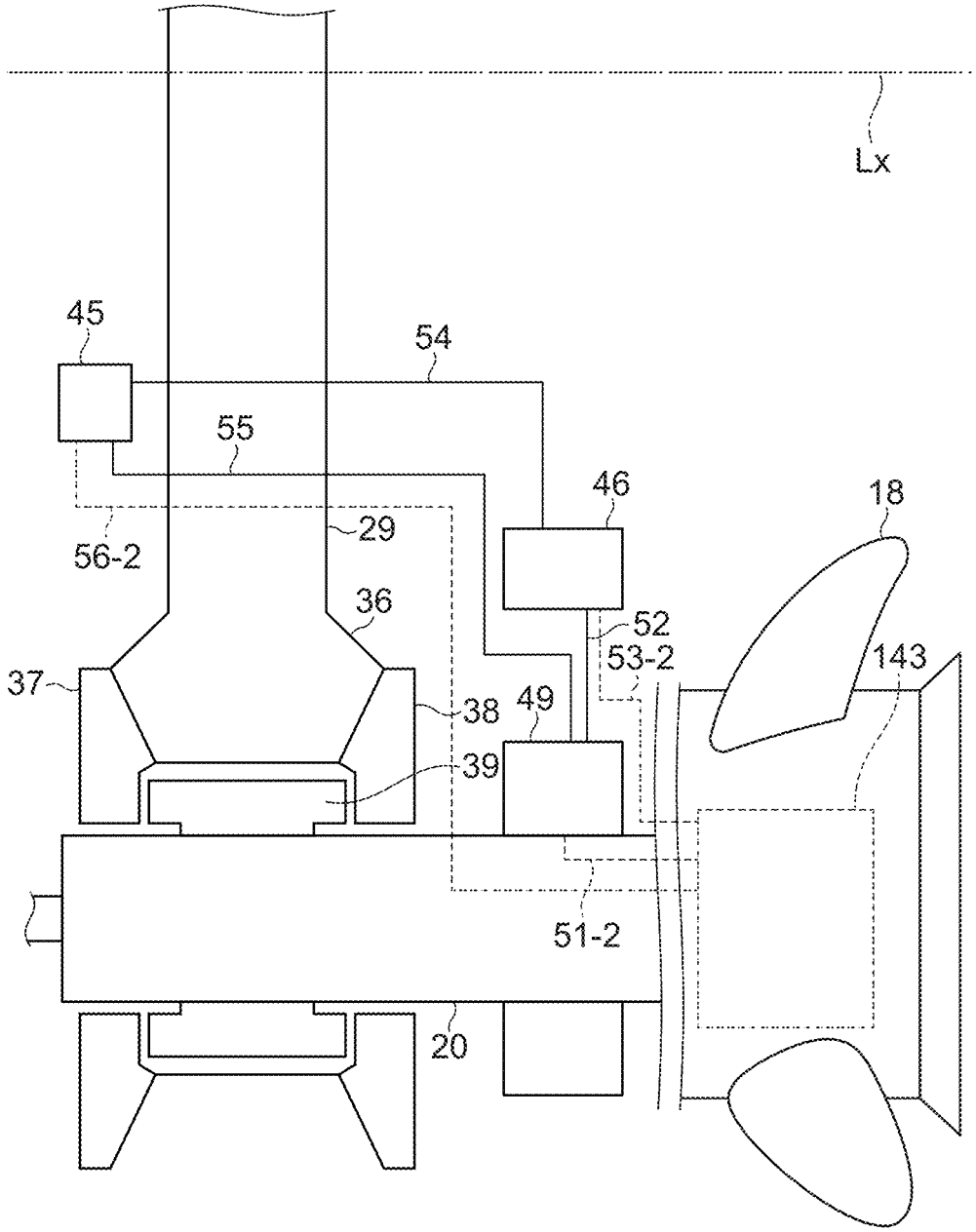
FIG. 6 is a schematic left side view of a lower portion of an outboard motor according to a second preferred embodiment of the present invention.

FIG. 6 is a schematic left side view of a lower portion of the outboard motor 3 according to the second preferred embodiment of the present invention.

The second preferred embodiment differs from the first preferred embodiment (FIG. 2) in that as the electric actuator, a blade angle adjusting unit 143 is used in place of the shift actuator 43. As the driven unit, the propeller 18 is used in place of the forward-reverse shifting mechanism 44. In the present preferred embodiment, the propeller 18 is a variable pitch propeller whose blade angle is adjusted by the blade angle adjusting unit 143. The blade angle adjusting unit 143 and the variable pitch propeller may have well-known configurations. A horizontal line Lx may be either the borderline L2 or the waterline L1.

The configurations and wiring of the power lines 52, 54, and 55 are the same as those in the first preferred embodiment. A first power line 51-2 supplies the power generated by the power generating unit 49 to the blade angle adjusting unit 143. A third power line 53-2 supplies the power from the capacitor 46 to the blade angle adjusting unit 143. The outboard motor ECU 45 and the blade angle adjusting unit 143 are connected to each other by a signal line 56-2. The blade angle adjusting unit 143, the first power line 51-2, the third power line 53-2, and the signal line 56-2 are located in the lower case 14 and at a lower level than the horizontal line Lx (the borderline L2 or the waterline L1).

According to the second preferred embodiment, similar effects to that in the first preferred embodiment are achieved regarding simplification of the wiring of the power lines.

Figure 7:
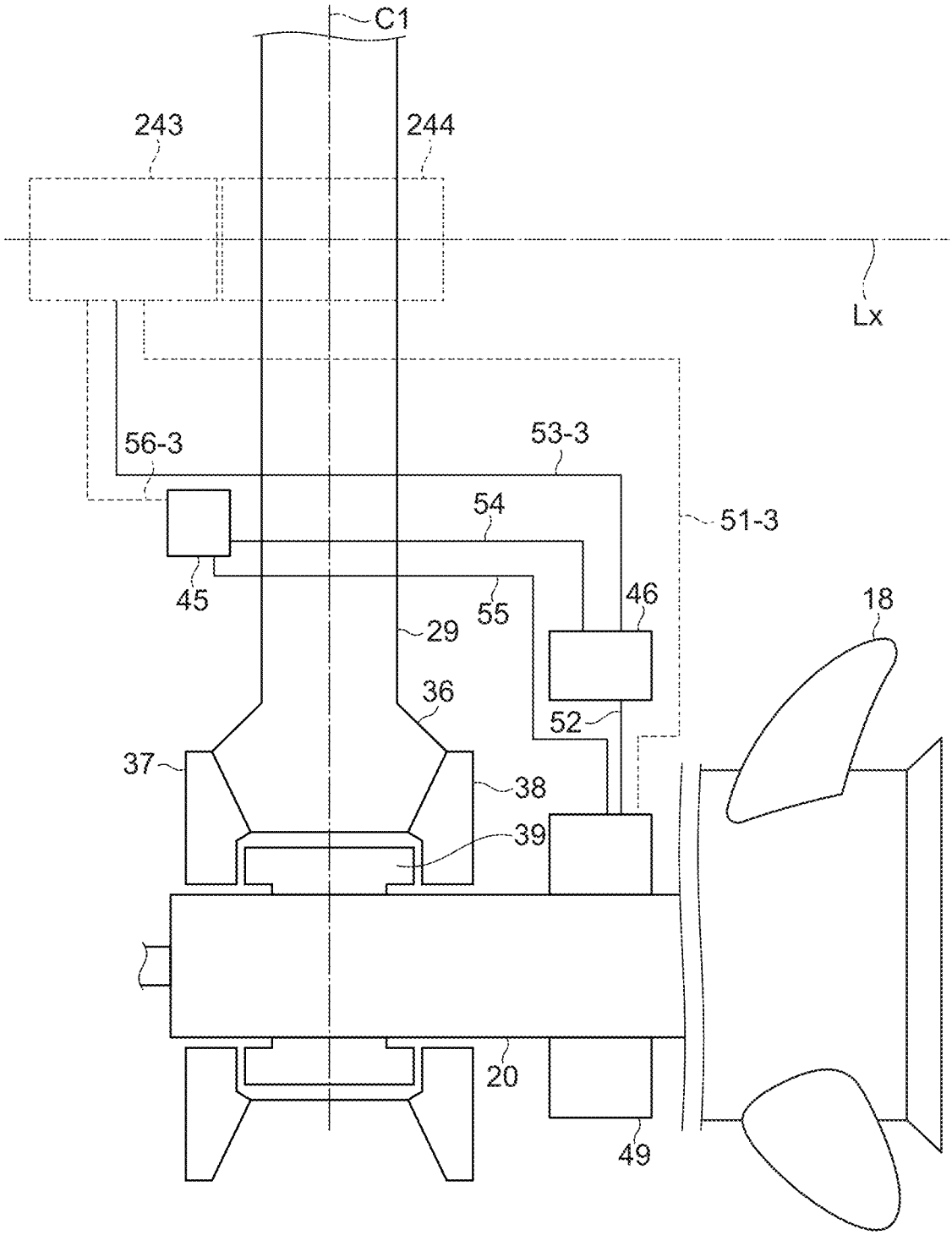
FIG. 7 is a schematic left side view of a lower portion of an outboard motor according to a third preferred embodiment of the present invention.

FIG. 7 is a schematic left side view of a lower portion of the outboard motor 3 according to the third preferred embodiment of the present invention.

The third preferred embodiment differs from the first preferred embodiment (FIG. 2) in that as the electric actuator, a steering mechanism actuator 243 is used in place of the shift actuator 43. As the driven unit, a lower steering mechanism 244 is used in place of the forward-reverse shifting mechanism 44. A well-known configuration may be used for the lower steering mechanism 244. The lower steering mechanism 244 is a connecting unit that connects the lower case 14 to the upper case 13 such that the lower case 14 is able to swing right and left about the axis C1 of the drive shaft 29 relatively to the upper case 13. The steering mechanism actuator 243 drives the lower steering mechanism 244 to swing the lower case 14 right and left relatively to the upper case 13.

The configurations and wiring of the power lines 52, 54, and 55 are the same as those in the first preferred embodiment. A first power line 51-3 supplies the power generated by the power generating unit 49 to the steering mechanism actuator 243. A third power line 53-3 supplies the power from the capacitor 46 to the steering mechanism actuator 243. The outboard motor ECU 45 and the steering mechanism actuator 243 are connected to each other by a signal line 56-3. At least a portion of the steering mechanism actuator 243, at least a portion of the lower steering mechanism 244, the first power line 51-3, the third power line 53-3, and the signal line 56-3 are located in the lower case 14 and at the lower level than the horizontal line Lx (the borderline L2 or the waterline L1).

According to the third preferred embodiment, similar effects to that in the first preferred embodiment are achieved including simplification of the wiring of the power lines.

Note that the steering mechanism actuator 243 and the lower steering mechanism 244 may be entirely located in the lower case 14 and at the lower level than the horizontal line Lx (the borderline L2 or the waterline L1).

Figure 8:
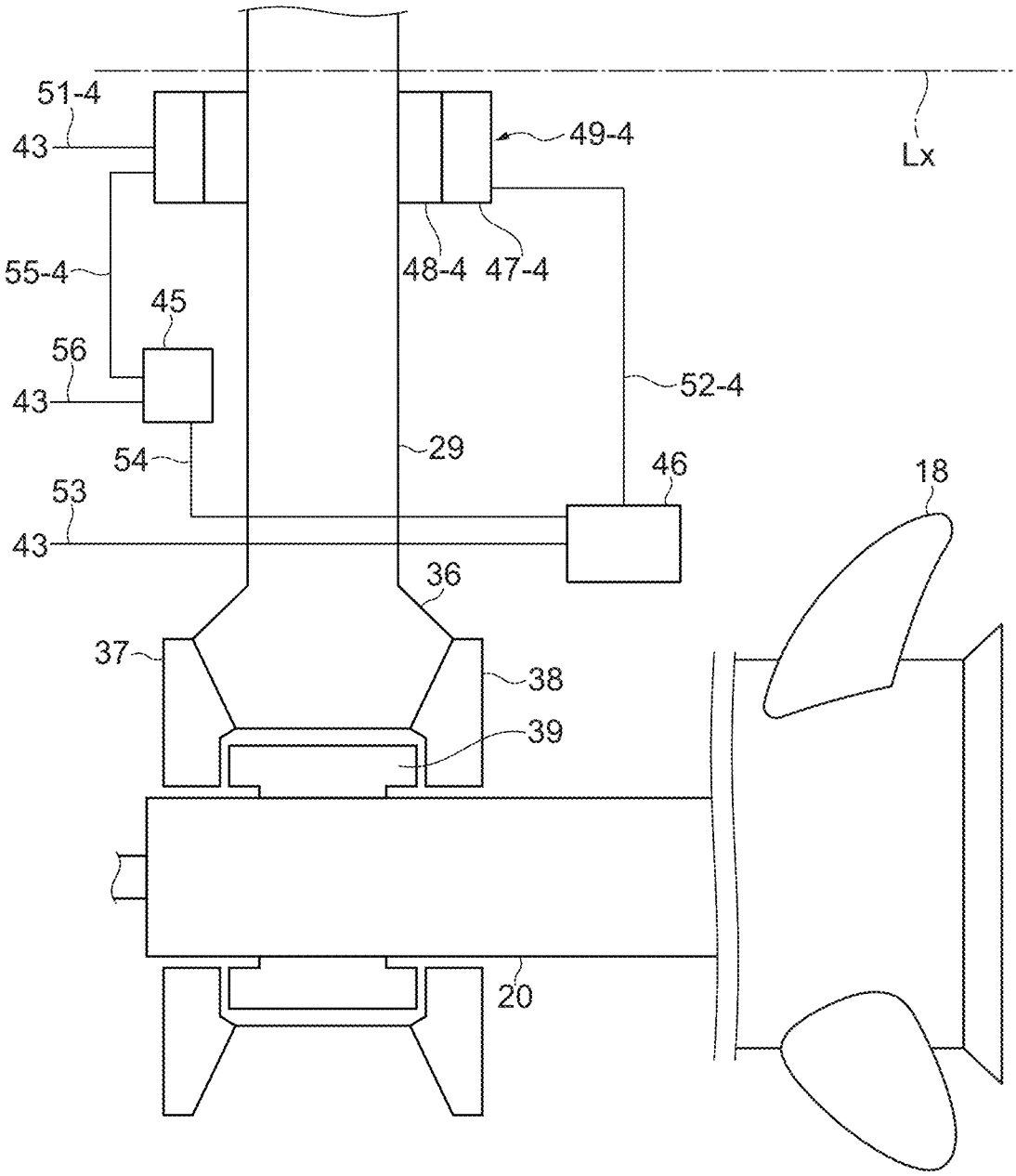
FIG. 8 is a schematic left side view of a lower portion of an outboard motor according to a fourth preferred embodiment of the present invention.

FIG. 8 is a schematic left side view of a lower portion of the outboard motor 3 according to the fourth preferred embodiment of the present invention. In FIG. 8, neither the shift actuator 43 nor the forward-reverse shifting mechanism 44 are illustrated.

In the fourth preferred embodiment, a power generating unit 49-4 placed at a location different from the location of the power generating unit 49 in the first preferred embodiment (FIG. 2), is used. The power generating unit 49-4 includes a coil 47-4 and a magnet 48-4, both of which are disposed around the drive shaft 29. The magnet 48-4 is fixed to the drive shaft 29 and rotates in conjunction with the drive shaft 29. The coil 47-4 is fixed to the lower case 14, wherein the magnet 48-4 is rotatable relatively to the coil 47-4. Thus, the power generating unit 49-4 generates power using the torque of the drive shaft 29.

The configurations and wiring of the power lines 53 and 54 are the same as those in the first preferred embodiment. A first power line 51-4 supplies the power generated by the power generating unit 49-4 to the shift actuator 43. A second power line 52-4 supplies the power generated by the power generating unit 49-4 to the capacitor 46. A fifth power line 55-4 supplies the power generated by the power generating unit 49-4 to the outboard motor ECU 45.

The power generating unit 49-4, the shift actuator 43, the forward-reverse shifting mechanism 44, the first power line 51-4, the second power line 52-4, and the fifth power line 55-4 are located in the lower case 14 and at the lower level than the horizontal line Lx (the borderline L2 or the waterline L1).

According to the fourth preferred embodiment, similar effects to that in the first preferred embodiment are achieved including simplification of the wiring of the power lines.

Note that at least a portion of the power generating unit 49-4 may be located in the lower case 14 and may be at the lower level than the horizontal line Lx (the borderline L2 or the waterline L1).

Note that in the preferred embodiments described above, a component to be fixed to the propeller shaft 20 or the drive shaft 29 and rotated in conjunction with its rotation may be either the coil or the magnet of the power generating unit. Thus, the coils 47 and 47-4 may be fixed to the propeller shaft 20 and the drive shaft 29, respectively, and the magnets 48 and 48-4 may be fixed to the lower case 14. The location at which the power generating unit is provided in the propeller shaft 20 or the drive shaft 29 is not limited to the illustrated location, and may be any location as long as the power generating unit is able to receive the torque of the propeller shaft 20 or the drive shaft 29.

Marine propulsion devices to which the present invention is applied are not limited to outboard motors. For example, the present invention is applicable to inboard/outboard motors (stern drive, inboard motor/outboard drive) and inboard motors.

Although the present invention has been described in detail by way of the preferred embodiments, the present invention should not be limited to those specific preferred embodiments, and various modifications and alterations can be made without departing from the gist of the present invention, and some of the preferred embodiments described above can be combined.

For example, the fourth preferred embodiment (FIG. 8) may be used for the location of a power generating unit, while the propeller 18 (FIG. 6) or the lower steering mechanism 244 (FIG. 7) may be used as a driven unit.

Note that the present invention is applicable to an electric marine propulsion device as well as a hybrid electric marine propulsion device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:
- a drive shaft;
- a propeller shaft;
- a lower case that houses the propeller shaft;
- a power generator to generate power using a torque of the drive shaft or the propeller shaft;
- a driven unit;
- an electric actuator to drive the driven unit;
- a first power line to supply the power generated by the power generator to the electric actuator; and
- a controller configured or programmed to control the electric actuator; wherein
- at least a portion of the driven unit, at least a portion of the electric actuator, at least a portion of the power generator, and the first power line are located in the lower case.

2. The marine propulsion device according to claim 1, further comprising:
- a capacitor to store the power generated by the power generator;
- a second power line to supply the power generated by the power generator to the capacitor; and
- a third power line to supply the power from the capacitor to the electric actuator; wherein
- the capacitor, the second power line, and the third power line are located in the lower case.

3. The marine propulsion device according to claim 2, further comprising:
- a fourth power line to supply the power from the capacitor to the controller; wherein
- the controller and the fourth power line are located in the lower case.

4. The marine propulsion device according to claim 1, further comprising:
- a signal line to connect the controller and the electric actuator together; wherein
- the controller and the signal line are located in the lower case.

5. The marine propulsion device according to claim 1, further comprising:
- a fifth power line to supply the power from the power generator to the controller; wherein
- the controller and the fifth power line are located in the lower case.

6. The marine propulsion device according to claim 1, wherein
- the power generator includes a coil and a magnet; and
- one of the coil and the magnet rotates in conjunction with the drive shaft or the propeller shaft.

7. The marine propulsion device according to claim 1, wherein the driven unit includes a shifter to switch a shift position of a shifting mechanism.

8. The marine propulsion device according to claim 1, wherein the driven unit includes a variable pitch propeller.

9. The marine propulsion device according to claim 1, wherein the driven unit includes a connector to connect the lower case to an upper case so that the lower case is able to swing about an axis of the drive shaft.

10. A marine propulsion device for a marine vessel, the marine propulsion device comprising:
- a drive shaft;
- a propeller shaft;
- a power generator to generate power using a torque of the drive shaft or the propeller shaft;
- a driven unit;
- an electric actuator to drive the driven unit;
- a first power line to supply the power generated by the power generator to the electric actuator; and a controller configured or programmed to control the electric actuator; wherein at least a portion of the driven unit, at least a portion of the electric actuator, at least a portion of the power generator, and the first power line are located at a lower level than a waterline in a state where the marine propulsion device is in a tilt-down state and the marine vessel is not sailing.

11. The marine propulsion device according to claim 10, wherein at least a portion of the driven unit, at least a portion of the electric actuator, at least a portion of the power generator, and the first power line are located within an area that is submerged in water while the marine vessel is sailing.

12. The marine propulsion device according to claim 10, further comprising:

a capacitor to store the power generated by the power generator;

a second power line to supply the power generated by the power generator to the capacitor; and a third power line to supply the power from the capacitor to the electric actuator; wherein the capacitor, the second power line, and the third power line are located at the lower level than the waterline in the state where the marine propulsion device is in the tilt-down state and the marine vessel is not sailing.

* * * * *